United States Patent [19]

Dubreux et al.

[11] Patent Number: 4,552,563

[45] Date of Patent: Nov. 12, 1985

[54] COMPOSITION FOR THE ALKALINE BLEACHING OF TEXTILES CONTAINING PEROXYAMINE

[75] Inventors: Bernard Dubreux, Francheville le Bas; Jackie Emeraud, Jouy en Josas; Gerard Tatin, Mulhouse; Jean-Pierre Schirmann, Oullins, all of France

[73] Assignee: Atochem, France

[21] Appl. No.: 650,778

[22] Filed: Sep. 13, 1984

[30] Foreign Application Priority Data

Sep. 20, 1983 [FR] France ..... 83 14911

[51] Int. Cl.[4] ..... D06L 3/00

[52] U.S. Cl. ..... 8/107; 8/101; 8/137; 568/566

[58] Field of Search ..... 8/107

[56] References Cited

U.S. PATENT DOCUMENTS 3,746,646 7/1973 Boixader ..... 8/111
4,110,242 8/1978 Hase et al. ..... 8/107

OTHER PUBLICATIONS

E. G. E. Hawkins, J. Chem. Soc. (c), 1969, pp. 2663–2670, 2671–2677, 2678–2681.

*Primary Examiner*—A. Lionel Clingman
*Attorney, Agent, or Firm*—Sigalos & Levine

[57] ABSTRACT

A composition for the alkaline bleaching of textiles during washing comprising a washing product and at least one peroxide derivative of the general formula:

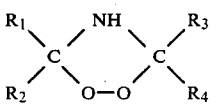

(I)

where $R_1$, $R_2$, $R_3$, and $R_4$ are hydrogen, a linear alkyl radical containing from 1 to 12 carbon atoms, a cycloalkyl or branched alkyl radical containing from 3 to 12 carbon atoms, or an aromatic hydrocarbon radical having from 6 to 12 carbon atoms; said radicals being unsubstituted or substituted by chlorine, bromine, fluorine, a nitro group, hydroxy group, alkoxy group, ethylenic derivatives, or carboxylic ester and $R_1$ and $R_2$ and/or $R_3$ and $R_4$, respectively, capable of forming only a single linear or branched radical having from 3 to 12 carbon atoms and the process of alkaline bleaching using the same.

6 Claims, No Drawings

COMPOSITION FOR THE ALKALINE BLEACHING OF TEXTILES CONTAINING PEROXYAMINE

BACKGROUND OF THE INVENTION

The present invention concerns compositions based on peroxide derivatives for the alkaline bleaching of textiles whose performances are superior to those of sodium perborate or sodium percarbonate.

The use of persalts as bleaching agents in formulations for household washing has been known for a long time. In particular, sodium percarbonate and sodium perborate, above all the latter, are currently being used in formulas of major brands of washing compounds such as detergent powders. These persalts are advantageous, since they constitute an effective means for storing hydrogen peroxide in the solid state, thus ensuring a better stability, and they also dissolve in the wash water and liberate the hydrogen peroxide which due to this fact is the true oxidizing agent.

In the alkaline medium of the washing bath, the hydrogen peroxide is unstable and partially decomposes into water and oxygen. The hydrogen peroxide is likewise sensitive to the presence of heavy metal ions whose harmful action can be reduced by the addition of sequestering agents.

In spite of the instability of the hydrogen peroxide, formulations based on persalts, well known in the art, can produce an acceptable bleaching action at temperatures at least equal to 60° C. However, such formulations present two major drawbacks: (1) the performance of the proteolytic enzymes which they generally contain is diminished by the presence of the persalts, and (2) the formulations present a disadvantageous sensitivity to the enzymes, such as catalases, coming from the soil contamination of textiles. Catalases, whose action was described for the first time by THENARD in 1818, have been discovered in blood clots. Certain aerobic bacterias contain them. Catalases cause the decomposition of hydrogen peroxide. Certain persons naturally generate catalase and, thus, during the washing of dirty clothes which they have worn, a persalt such as sodium perborate can be decomposed without there being a bleaching effect.

In order to remedy those drawbacks, it has been proposed in U.S. Pat. No. 3,746,646, to replace the hydrogen peroxide on the persalts with organic hydroperoxides; or, more particularly, because of their generally very low solubility in water, by derivatives of these hydroperoxides such as their alkaline salts. Such a substitution has the disadvantage of not being able to produce a notable bleaching effect except at a temperature higher than that obtained with the persalts or only with the help of activation by transition metal salts inevitably aggravating pollution.

SUMMARY OF THE INVENTION

The compositions of the present invention under real washing conditions provide an excellent bleaching performance which is far superior to the formulations based on persalts, as well as impairing far less the effect of the proteolytic enzymes which they may also contain.

In brief, the present invention comprises compositions for the alkaline bleaching of textiles comprising a washing product and/or enzymes and at least one peroxide derivative of the general formula:

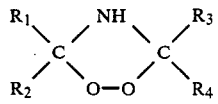

(I)

where $R_1$, $R_2$, $R_3$, and $R_4$ are hydrogen, a linear alkyl radical containing from 1 to 12 carbon atoms, a cycloalkyl or branched alkyl radical containing from 3 to 12 carbon atoms, or an aromatic hydrocarbon radical having from 6 to 12 carbon atoms; said radicals being unsubstituted or substituted by chlorine, bromine, fluorine, a nitro group, hydroxy group, alkoxy group, ethylenic derivatives, or carboxylic ester and $R_1$ and $R_2$ and/or $R_3$ and $R_4$, respectively, capable of forming only a single linear or branched radical having from 3 to 12 carbon atoms.

The invention also comprises the processes of bleaching utilizing said compositions.

DETAILED DESCRIPTION

The compositions and process of the invention are characterized by the utilization of at least one peroxide derivative having the following general formula:

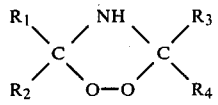

(I)

Such compounds, as well as their preparations, are described in the article by E. G. E. HAWKINS, J. Chem. Soc., (1969), 191, pp. 2678–2681.

In formula (I) $R_1$, $R_2$, $R_3$, and $R_4$ can be identical or different and are selected from hydrogen, a linear alkyl radical having from 1 to 12 carbon atoms, a cycloalkyl or branched alkyl radical having from 3 to 12 carbon atoms, an aromatic hydrocarbon radical having from 6 to 12 carbon atoms, and are substituted or not substituted by chlorine, bromine, fluorine, a nitro group, hydroxy group, alkoxy group, or an ethylenic derivative or carboxylic ester, with $R_1$ and $R_2$ and/or $R_3$ and $R_4$, respectively, capable of forming only a single linear or branched alkylene radical having from 3 to 12 carbon atoms.

The washing powders can be any conventional soaps or detergents conventionally used for this purpose. Further the compositions of the present invention can contain one or several proteolytic enzymes.

This invention will be further illustrated in conjunction with the following examples which are set forth for purposes of illustration only and not by way of limitation. In the examples, products A and B, representative of peroxide derivative compounds of the present invention and whose respective formulas are:

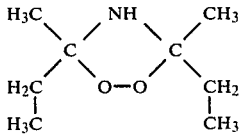

(A)

and

-continued

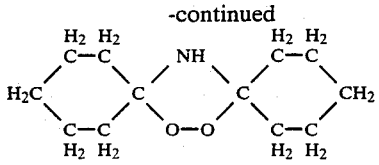

(B)

have been tested in bleaching formulations and their sensitivity to bacterial catalase has been compared to that of sodium perborate. The strain of bacteria selected was the strain of CORYNEBACTERIUM sp. CIP 100 133, available at the Institute PASTEUR, 25 rue du Docteur ROUX, 75015 PARIS, FRANCE, containing $2\times10^8$ bacteria per milliliter and prior to use incubated during 24 hours at 28° C. in medium having the following composition:

| | |
|---|---|
| Trypsinized peptone from casein | 10 g |
| Meat extract as paste | 3 g |
| Sodium chloride | 5 g |
| Yeast extract | 0.5 g |
| Agar agar | 20 g |
| Demineralized water | 1000 ml |

The bacteria were introduced into the test medium containing washing compounds by the use of a physiological liquid containing 9 g/l of sodium chloride.

The performances of products A and B were also evaluated, in comparison with those of sodium perborate, in bleaching formulations containing a proteolytic enzyme.

EXAMPLE 1
(COMPARATIVE EXAMPLE)

A bath containing 1 g/l of sodium perborate tetrahydrate and 5.7 g of washing compounds based on EMPA is inoculated with 40 ml of bacterial catalase solution, as defined above, per liter of said bath; said bath thus containing $8\times10^6$ bacteria per milliliter after inoculation.

This inoculated bath served for washing tests on EMPA fabric stained with red wine according to the following washing cycle: the temperature was raised in 30 minutes to 90° C. and kept at this level for 30 minutes.

The white obtained was measured before and after washing with a ZEISS-ELREPHO reflectometer.

The bleaching power is expressed in percent by the ratio:

$$\frac{\text{final white} - \text{initial white}}{100 - \text{initial white}}$$

and amounted to 36.1%.

EXAMPLE 2

A bath containing 1 g/l of product A in place of sodium perborate and 5.7 g/l of washing compounds based on EMPA was inoculated as described in Example 1 and was tested on EMPA fabric stained with red wine according to the washing cycle defined in Example 1.

The bleaching power was found to be equal to 46.7%, thus well above the formulation of Example 1 containing the presence of sodium perborate, and this result in the presence of catalase; that is to say, under actual washing conditions.

EXAMPLES 3 to 5

Examples 3 to 5 relate to compositions containing a proteolytic enzyme; ESPERASE from the NOVO Company, with Examples 3 and 4 being comparative examples.

In Example 3 a bath comprising a washing compound based on EMPA containing 0.4% of ESPERASE served for the washing of EMPA 116 fabric (protein-containing stains such as milk, blood, and India ink) at 60° C. according to the following washing cycle: the temperature was raised to 60° C. in 15 minutes and kept at the level of this temperature for 30 minutes, and then raised to 90° C. with temperature rise duration and level duration both equal to 30 minutes. The values of bleaching power obtained are listed in TABLE I below.

For Example 4, the same washing tests as in Example 3 were carried out with a bath containing 1 g/l of sodium perborate tetrahydrate, 5.7 g/l of washing compounds based on EMPA and 0.0268 g/l of ESPERASE.

The values of bleaching power obtained are listed in TABLE I.

For Example 5, the same washing tests as in the two preceding examples were carried out with a bath containing 1 g/l of product A, 5.7 g/l of washing compounds based on EMPA and 0.0268 g/l of ESPERASE.

The values of bleaching power obtained are listed in TABLE I.

TABLE

| No. of Example | 3 | | 4 | | 5 | |
|---|---|---|---|---|---|---|
| Temperature, °C. | 60 | 90 | 60 | 90 | 60 | 90 |
| Bleaching power in % | 37.4 | 39.4 | 20.3 | 15.3 | 31.6 | 29.0 |

The results of TABLE I clearly show that at 60° C., as well as at 90° C., the activity of ESPERASE is very clearly less affected by product A than by sodium perborate.

EXAMPLE 6

A bath containing 2.3 g/l of product B, that is to say the same number of peroxy equivalents which product A contributed in Example 2, and 5.7 g/l of washing compounds based on EMPA, was inoculated as described in Example 1 and tested as in Example 2.

The bleaching power obtained amounted to 43%.

EXAMPLE 7

By operating as in Example 5, but by replacing product A by product B at a rate of 1.3 g/l, the bleaching power is equal to 32.4% for the washing cycle at 60° C. and equal to 31.2% for the washing cycle at 90° C.

Examples 6 and 7 show that the washing compound compositions containing product A are comparable to those formulations containing product B.

While the invention has been described in connection with a preferred embodiment, it is not intended to limit the scope of the invention to the paraticular form set forth, but, on the contrary, it is intended to cover such alternatives, modifications, and equivalents as may be included within the spirit and scope of the invention as defined by the appended claims.

What is claimed is:

1. A composition for the alkaline bleaching of textiles during washing comprising a washing powder and at least one peroxide derivative of the general formula:

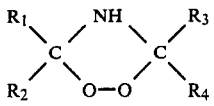

(I)

where $R_1$, $R_2$, $R_3$, and $R_4$ are hydrogen, a linear alkyl radical containing from 1 to 12 carbon atoms, a cycloalkyl or branched alkyl radical containing from 3 to 12 carbon atoms, or an aromatic hydrocarbon radical having from 6 to 12 carbon atoms; $R_1$ and $R_2$ and/or $R_3$ and $R_4$, respectively, capable of forming a cycloalkyl radical having from 3 to 12 carbon atoms.

2. The composition of claim 1, wherein the peroxide derivative is:

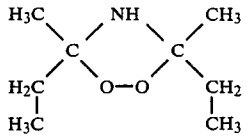

3. The composition of claim 1, wherein the peroxide derivative is:

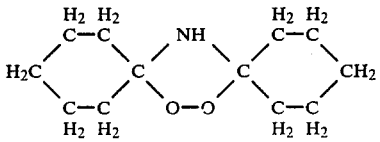

4. The compositions of claims 1, 2, or 3, wherein said formulation contains at least one proteolytic enzyme.

5. The process for the alkaline bleaching of textiles comprising contacting said textiles in an aqueous medium with composition of claims 1, 2, or 3 for a time and at a temperature sufficient to complete the bleaching process.

6. The process of claim 5, wherein said composition also contains at least one proteolytic enzyme.

* * * * *